US008387578B2

(12) United States Patent
Fischer

(10) Patent No.: US 8,387,578 B2
(45) Date of Patent: Mar. 5, 2013

(54) CAMSHAFT PHASER WITH DUAL LOCK PINS AND A PASSAGE WITHIN THE CAMSHAFT PHASER CONNECTING THE LOCK PINS

(75) Inventor: Thomas H. Fischer, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 87 days.

(21) Appl. No.: 13/159,523

(22) Filed: Jun. 14, 2011

(65) Prior Publication Data

US 2012/0318219 A1 Dec. 20, 2012

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 8,051,818 B2 * 11/2011 Myers et al. ..... 123/90.17
2009/0266322 A1 10/2009 Fischer

* cited by examiner

*Primary Examiner* — Ching Chang
(74) *Attorney, Agent, or Firm* — Timothy N. Twomey

(57) ABSTRACT

A camshaft phaser is provided for varying the phase relationship between a crankshaft and a camshaft in an engine. The camshaft phaser includes a stator having lobes. A rotor is disposed within the stator and includes vanes interspersed with the stator lobes to define alternating advance and retard chambers. A primary lock pin is provided for selective engagement with a primary lock pin seat for limiting rotation between the rotor and stator to a range between full advance and full retard. A secondary lock pin is provided for selective engagement with a secondary lock pin seat for preventing rotation between the rotor and the stator at a predetermined position within the range. A cap is disposed axially adjacent the rotor to define a bridging lock pin oil passage therebetween. The bridging lock pin oil passage provides fluid communication between the primary lock pin and the secondary lock pin.

6 Claims, 7 Drawing Sheets

CAMSHAFT PHASER WITH DUAL LOCK PINS AND A PASSAGE WITHIN THE CAMSHAFT PHASER CONNECTING THE LOCK PINS

TECHNICAL FIELD OF INVENTION

The present invention relates to a hydraulically actuated camshaft phaser for varying the phase relationship between a crankshaft and a camshaft in an internal combustion engine; more particularly to such a camshaft phaser that is a vane-type camshaft phaser, and still more particularly to a vane-type camshaft phaser which includes a primary lock pin, a secondary lock pin, and an oil passage within the camshaft phaser providing fluid communication of the primary lock pin with the secondary lock pin.

BACKGROUND OF INVENTION

A typical vane-type camshaft phaser generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vacated from the other of the advance and retard chambers in order to rotate the rotor within the stator and thereby change the phase relationship between an engine camshaft and an engine crankshaft. Camshaft phasers also commonly include two intermediate lock pins which selectively prevent relative rotation between the rotor and the stator at an angular position that is intermediate of a full advance and a full retard position. One example of such a camshaft phaser is described in United States Patent Application Publication number US 2009/0266322-A1. In this example, a primary lock pin is selectively seated in a primary lock pin seat which is elongated to allow relative rotation between the rotor and the stator in a range that is between full advance and full retard. The secondary lock pin is selectively seated in a secondary lock pin seat in order to substantially prevent relative rotation between the rotor and the stator at a predetermined position that is within the range. The primary lock pin assists in engagement of the secondary lock pin with the secondary lock pin seat by limiting rotation of the rotor to a small range when the primary lock pin is seated in the primary lock pin seat. With the primary lock pin constraining rotation of the rotor to a small range, it is easier to precisely align the secondary lock pin with the secondary lock pin seat which fit together very closely in order to substantially prevent relative rotation between the rotor and the stator.

Now referring to FIG. 1, it is known to use pressurized oil from the internal combustion engine to disengage the primary and secondary lock pins from the primary and secondary lock pin seats respectively. Pressurized oil is supplied to annular groove 10 of camshaft 12. Primary lock pin camshaft oil passage 14 extends axially into camshaft 12 and is in fluid communication with annular groove 10 through primary lock pin camshaft connecting passage 16 which extends radially into camshaft 12. Primary lock pin camshaft oil passage 14 is aligned with primary lock pin rotor oil passage 18 which extends axially into rotor 20. Primary lock pin rotor oil passage 18 is in fluid communication with primary lock pin 22 through primary lock pin rotor connecting passage 24 which extends radially into rotor 20. Similarly, secondary lock pin camshaft oil passage 26 extends axially into camshaft 12 and is in fluid communication with annular groove 10 through secondary lock pin camshaft connecting passage 28 which extends radially into camshaft 12. Secondary lock pin camshaft oil passage 26 is aligned with secondary lock pin rotor oil passage 30 which extends axially into rotor 20. Secondary lock pin rotor oil passage 30 is in fluid communication with secondary lock pin 32 through secondary lock pin rotor connecting passage 34 which extends radially into rotor 20.

While this arrangement of one axial lock pin oil passage in the camshaft for each lock pin may be satisfactory for some applications, it may be unsatisfactory for other applications. For example, an internal combustion engine manufacturer that had previously employed a camshaft phaser with a single lock pin, and consequently only one axial lock pin oil passage in the camshaft for communication with the lock pin, may wish to switch to a camshaft phaser with a dual lock pin arrangement. A redesign of the camshaft would be required to include a second axial lock pin oil passage in the camshaft in order to accommodate the second lock pin of the camshaft phaser. This redesign may be costly and time intensive.

This arrangement of one axial lock pin oil passage in the camshaft for each lock pin may also be unsatisfactory for some applications due to a limited availability of space in the camshaft. More specifically, the camshaft may include a plurality oil passages for supplying oil to and from the advance and retard chambers of the camshaft phaser. This plurality of oil passages for supplying oil to and from the advance and retard chambers may leave insufficient space for multiple axial lock pin oil passages in the camshaft.

What is needed is a camshaft phaser having primary and secondary lock pins and a single hydraulic interface with the internal combustion engine for communication of oil to and from both the primary and secondary lock pins. What is also needed is such a camshaft phaser which includes a rotor and a cap disposed axially adjacent to the rotor to define a lock pin passage therebetween which provides fluid communication between the primary and secondary lock pins.

SUMMARY OF THE INVENTION

Briefly described, a camshaft phaser is provided for controllably varying the phase relationship between a crankshaft and a camshaft in an internal combustion engine. The camshaft phaser includes a stator having a plurality of lobes and is connectable to the crankshaft of the internal combustion engine to provide a fixed ratio of rotation between the stator and the crankshaft. The camshaft phaser also includes a rotor coaxially disposed within the stator and having a plurality of vanes interspersed with the stator lobes defining alternating advance chambers and retard chambers. The advance chambers receive pressurized oil in order to change the phase relationship between the crankshaft and the camshaft in the advance direction while the retard chambers receive pressurized oil in order to change the phase relationship between the camshaft and the crankshaft in the retard direction. The rotor is attachable to the camshaft of the internal combustion engine to prevent relative rotation between the rotor and the camshaft. A primary lock pin is disposed within one of the rotor and the stator for selective engagement with a primary lock pin seat for limiting a change in phase relationship between the rotor and the stator to a range between full advance and full retard when the primary lock pin is engaged with the primary lock pin seat. Pressurized oil is selectively supplied to the primary lock pin in order to disengage the primary lock pin with the primary lock pin seat, and oil is selectively vented from the primary lock pin in order to engage the primary lock pin with the primary lock pin seat. A secondary lock pin is disposed within one of the rotor and the stator for selective engagement with a secondary lock pin seat for preventing a change in phase relationship between the rotor and the stator at a predetermined position within the range when the secondary lock pin is engaged with the secondary lock pin seat. Pressurized oil is selectively supplied to the secondary lock pin in order to disengage the secondary lock pin with the secondary lock pin seat, and oil is selectively vented from the secondary lock pin in order to engage the secondary lock pin with the secondary lock pin seat. A cap is disposed axially adjacent the rotor to define a bridging lock pin oil passage therebetween. The bridging lock pin oil passage provides fluid communication between the primary lock pin and the secondary lock pin.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
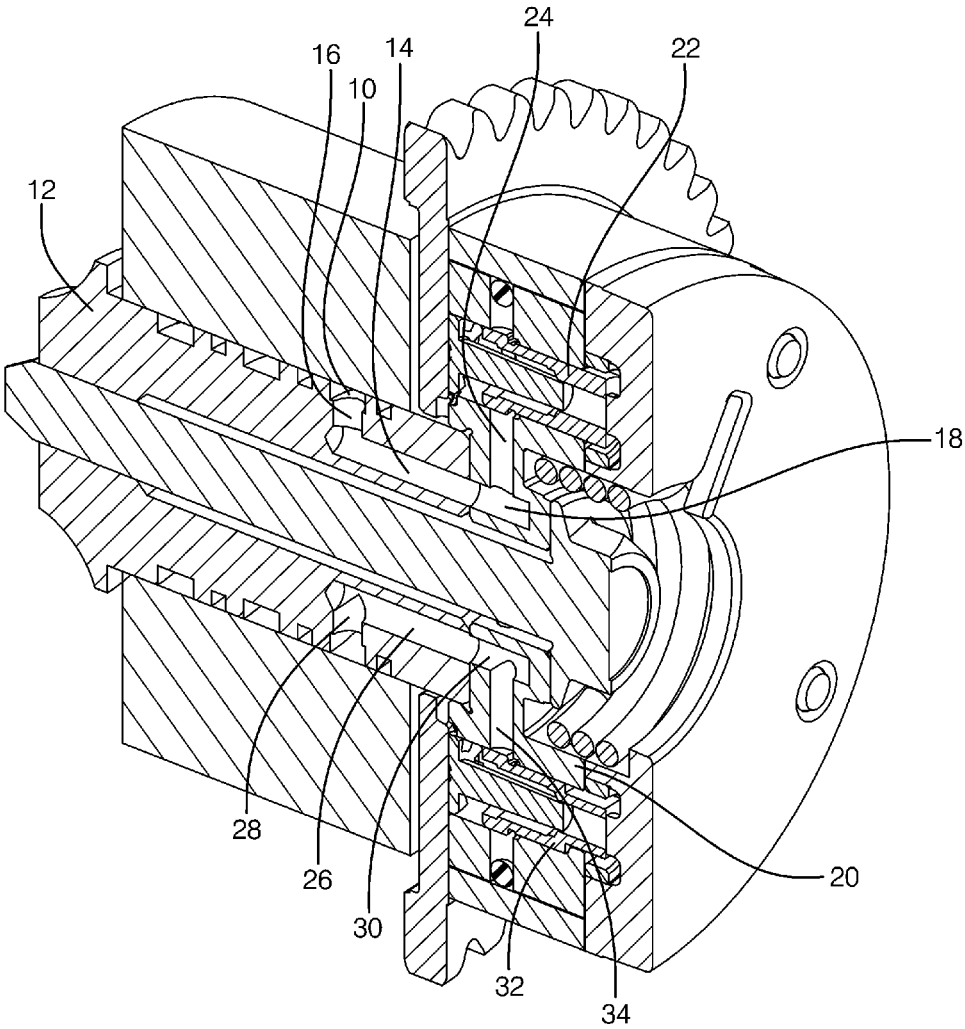
PRIOR ART FIG. 1
FIG. 1 is an isometric axial cross-section of a prior art camshaft phaser with separate oil passages for each lock pin.

In accordance with a preferred embodiment of this invention and referring to FIGS. 2-5, internal combustion engine 50 is shown which includes camshaft phaser 52. Internal combustion engine 50 also includes camshaft 54 which is rotatable based on rotational input from a crankshaft and chain (not shown) driven by a plurality of reciprocating pistons (also not shown). As camshaft 54 is rotated, it imparts valve lifting and closing motion to intake and/or exhaust valves (not shown) as is well known in the internal combustion engine art. Camshaft phaser 52 allows the timing between the crankshaft and camshaft 54 to be varied. In this way, opening and closing of the intake and/or exhaust valves can be advanced or retarded in order to achieve desired engine performance.

Camshaft phaser 52 includes sprocket 56 which is driven by a chain or gear (not shown) driven by the crankshaft of internal combustion engine 50. Alternatively, sprocket 56 may be a pulley driven by a belt. Sprocket 56 includes a central bore 58 for receiving camshaft 54 coaxially therethrough which is allowed to rotate relative to sprocket 56. Sprocket 56 is sealingly secured to stator 60 with sprocket bolts 62 in a way that will be described in more detail later.

Stator 60 is generally cylindrical and includes a plurality of radial chambers 64 defined by a plurality of lobes 66 extending radially inward. In the embodiment shown, there are four lobes 66 defining four radial chambers 64, however, it is to be understood that a different number of lobes 66 may be provided to define radial chambers 64 equal in quantity to the number of lobes 66.

Rotor 68 includes central hub 70 with a plurality of vanes 72 extending radially outward therefrom and central through bore 74 extending axially therethrough. The number of vanes 72 is equal to the number of radial chambers 64 provided in stator 60. Rotor 68 is coaxially disposed within stator 60 such that each vane 72 divides each radial chamber 64 into advance chambers 76 and retard chambers 78. The radial tips of lobes 66 are mateable with central hub 70 in order to separate radial chambers 64 from each other. Preferably, each of the radial tips of vanes 72 includes one of a plurality of wiper seals 80 to substantially seal adjacent advance and retard chambers 76, 78 from each other. Although not shown, each of the radial tips of lobes 66 may include a wiper seal similar in configuration to wiper seal 80.

Figure 4:
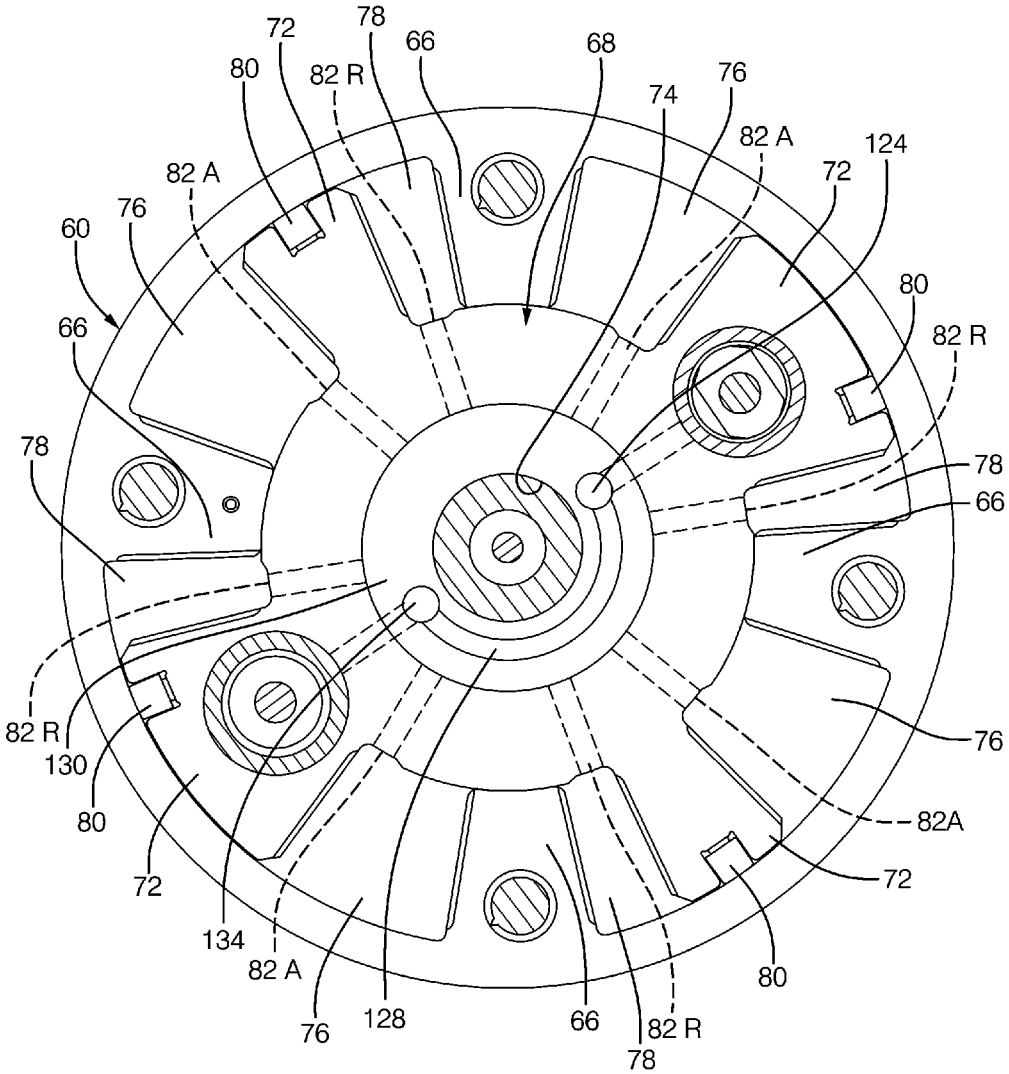
FIG. 4 is an radial cross-section of the camshaft phaser of FIG. 2.

Central hub 70 includes a plurality of oil passages 82A, 82R formed radially therethrough (best visible as hidden lines in FIG. 4). Each one of the plurality of oil passages 82A is in fluid communication with one of the advance chambers 76 for supplying oil thereto and therefrom while each one of the plurality of oil passages 82R is in fluid communication with one of the retard chambers 78 for supplying oil thereto and therefrom.

Bias spring 84 is disposed within annular pocket 86 formed in rotor 68 and within central bore 88 of camshaft phaser cover 90. Bias spring 84 is grounded at one end thereof to camshaft phaser cover 90 and is attached at the other end thereof to rotor 68. When internal combustion engine 50 is shut down, bias spring 84 urges rotor 68 to a predetermined angular position within stator 60 in a way that will be described in more detail in the subsequent paragraph.

Camshaft phaser 52 includes a staged dual lock pin system for selectively preventing relative rotation between rotor 68 and stator 60 at the predetermined angular position which is between the extreme advance and extreme retard positions. Primary lock pin 92 is slidably disposed within primary lock pin bore 94 formed in one of the plurality of vanes 72 of rotor 68. Primary lock pin seat 96 is formed in camshaft phaser cover 90 for selectively receiving primary lock pin 92 therewithin. Primary lock pin seat 96 is larger than primary lock pin 92 to allow rotor 68 to rotate relative to stator 60 in a range of about 5° on each side of the predetermined angular position when primary lock pin 92 is seated within primary lock pin seat 96. The enlarged nature of primary lock pin seat 96 allows primary lock pin 92 to be easily received therewithin. When primary lock pin 92 is not desired to be seated within primary lock pin seat 96, pressurized oil is supplied to primary lock pin 92, thereby urging primary lock pin 92 out of primary lock pin seat 96 and compressing primary lock pin spring 98. Conversely, when primary lock pin 92 is desired to be seated within primary lock pin seat 96, the pressurized oil is vented from primary lock pin 92, thereby allowing primary lock pin spring 98 to urge primary lock pin 92 toward camshaft phaser cover 90. In this way, primary lock pin 92 is seated within primary lock pin seat 96 by primary lock pin spring 98 when rotor 68 is positioned within stator 60 to allow alignment of primary lock pin 92 with primary lock pin seat 96.

Secondary lock pin 100 is slidably disposed within secondary lock pin bore 102 formed in one of the plurality of vanes 72 of rotor 68. Secondary lock pin seat 104 is formed in camshaft phaser cover 90 for selectively receiving secondary lock pin 100 therewithin. Secondary lock pin 100 fits within secondary lock pin seat 104 in a close sliding relationship, thereby substantially preventing relative rotation between rotor 68 and stator 60 at the predetermined angular position within the range when secondary lock pin 100 is received within secondary lock pin seat 104. When secondary lock pin 100 is not desired to be seated within secondary lock pin seat 104, pressurized oil is supplied to secondary lock pin 100, thereby urging secondary lock pin 100 out of secondary lock pin seat 104 and compressing secondary lock pin spring 106. Conversely, when secondary lock pin 100 is desired to be seated within secondary lock pin seat 104, the pressurized oil is vented from the secondary lock pin 100, thereby allowing secondary lock pin spring 106 to urge secondary lock pin 100 toward camshaft phaser cover 90. In this way, secondary lock pin 100 is seated within secondary lock pin seat 104 by secondary lock pin spring 106 when rotor 68 is positioned within stator 60 to allow alignment of secondary lock pin 100 with secondary lock pin seat 104.

When it is desired to prevent relative rotation between rotor 68 and stator 60 at the predetermined angular position, the pressurized oil is vented from both primary lock pin 92 and secondary lock pin 100, thereby allowing primary lock pin spring 98 and secondary lock pin spring 106 to urge primary and secondary lock pins 92, 100 respectively toward camshaft phaser cover 90. In order to align primary and secondary lock pins 92, 100 with primary and secondary lock pin seats 96, 104 respectively, rotor 68 may be rotated with respect to stator 60 by one or more of supplying pressurized oil to advance chambers 76, supplying pressurized oil to retard chambers 78, urging from bias spring 84, and torque from camshaft 54. Since primary lock pin seat 96 is enlarged, primary lock pin 92 will be seated within primary lock pin seat 96 before secondary lock pin 100 is seated within secondary lock pin seat 104. With primary lock pin 92 seated within primary lock pin seat 96, rotor 68 is allowed to rotate with respect to stator 60 by about 10°. Rotor 68 may be further rotated with respect to stator 60 by one or more of supplying pressurized oil to advance chambers 76, supplying pressurized oil to retard chambers 78, urging from bias spring 84, and torque from camshaft 54 in order to align secondary lock pin 100 with secondary lock pin seat 104, thereby allowing secondary lock pin 100 to be seated within secondary lock pin seat 104. Supply and venting of oil to and from advance chambers 76 and retard chambers 78 through oil passages 82A, 82R respectively is provided by an oil control valve (not shown) as is well known in the art of camshaft phasers. Supply and venting of oil to and from and primary and secondary lock pins 92, 100 will be described in more detail later.

Camshaft phaser cover 90 is sealingly attached to stator 60 by sprocket bolts 62 that extend through sprocket 56 and stator 60 and threadably engage camshaft phaser cover 90. In this way, stator 60 is secured between sprocket 56 and camshaft phaser cover 90 in order to axially and radially secure sprocket 56, stator 60, and camshaft phaser cover 90 to each other. Also in this way, advance and retard chambers 76, 78 are sealed axially between sprocket 56 and camshaft phaser cover 90.

Camshaft phaser 52 is angularly indexed to camshaft 54 using indexing slot 108 formed in the axial end of camshaft 54 and indexing pin 110 extending from rotor 68. In this way, angular alignment between rotor 68 and camshaft 54 is achieved. In order to secure camshaft phaser 52 to camshaft 54 after being angularly indexed to each other, camshaft phaser attachment bolt 112 is inserted coaxially through central through bore 74 of rotor 68 and is threadably engaged with camshaft 54. When camshaft phaser attachment bolt 112 is tightened to a predetermined torque, head 114 of camshaft phaser attachment bolt 112 applies an axial force to central hub 70 of rotor 68. In this way, rotor 68 is securely clamped to camshaft 54 and rotation between camshaft 54 and rotor 68 is prevented.

In order to supply and vent oil to and from and primary and secondary lock pins 92, 100 to position primary and secondary lock pins 92, 100 as desired and as described previously, annular oil groove 116 is provided in camshaft 54. Annular oil groove 116 is in fluid communication with an oil gallery (not shown) of camshaft bearing 118. Pressurized oil is supplied and vented from annular oil groove 116 by a lock pin oil control valve as is well known in the art of camshaft phasers. Annular oil groove 116 is in fluid communication with lock pin camshaft oil connecting passage 120 which extends radially into camshaft 54 from annular oil groove 116. Lock pin camshaft oil connecting passage 120 intersects with lock pin camshaft oil passage 122 which extends axially through camshaft 54 from lock pin camshaft oil connecting passage 120 to the axial end of camshaft 54 which mates with rotor 68.

Lock pin camshaft oil passage 122 is aligned with lock pin rotor oil passage 124 which extends axially through rotor 68. In order to provide fluid communication between lock pin rotor oil passage 124 and secondary lock pin bore 102/secondary lock pin 100, secondary lock pin connecting passage 126 extends radially from lock pin rotor oil passage 124 to secondary lock pin bore 102.

Figure 2:
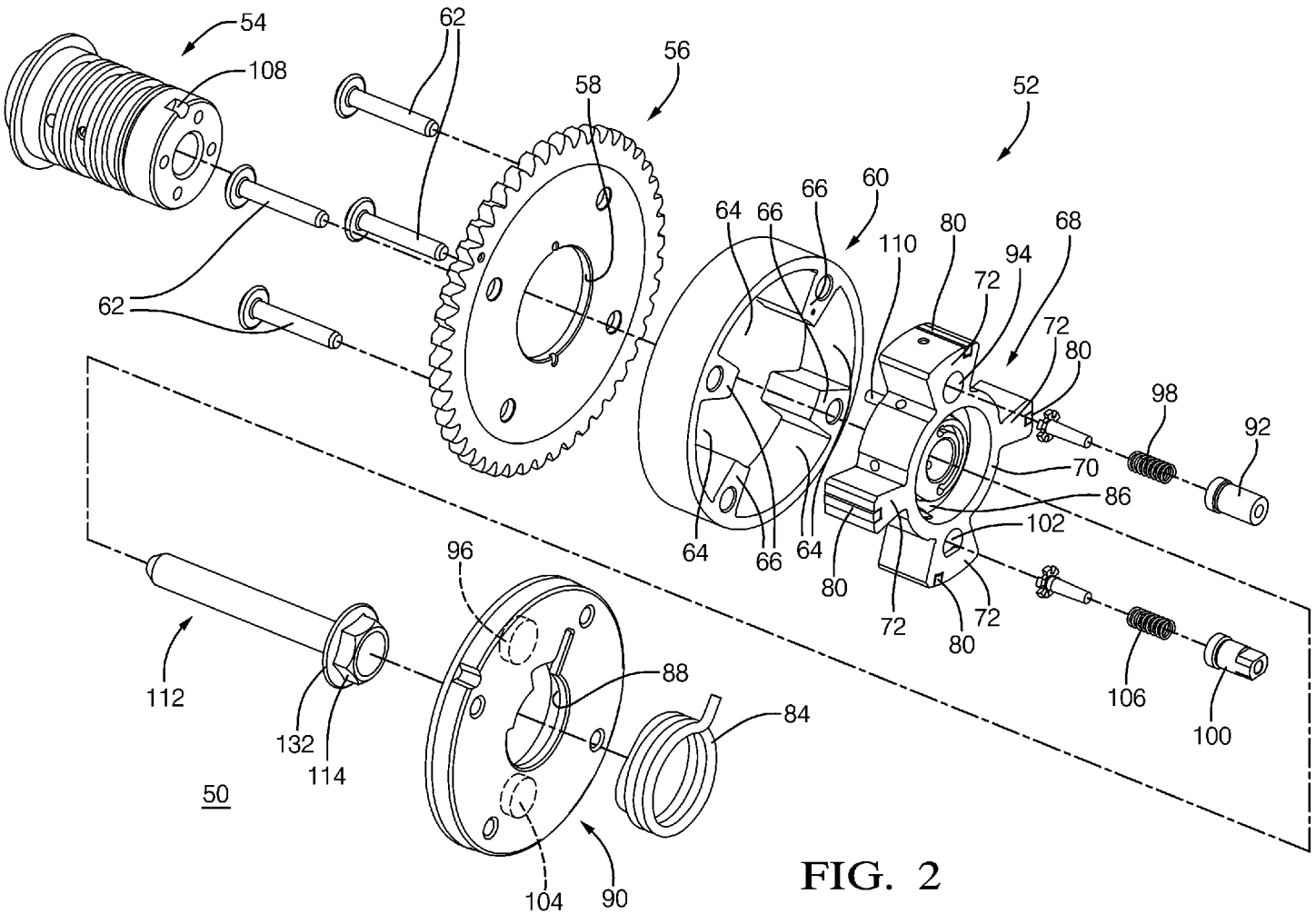
FIG. 2 is an exploded isometric view of a camshaft phaser in accordance with the present invention.
Figure 3:
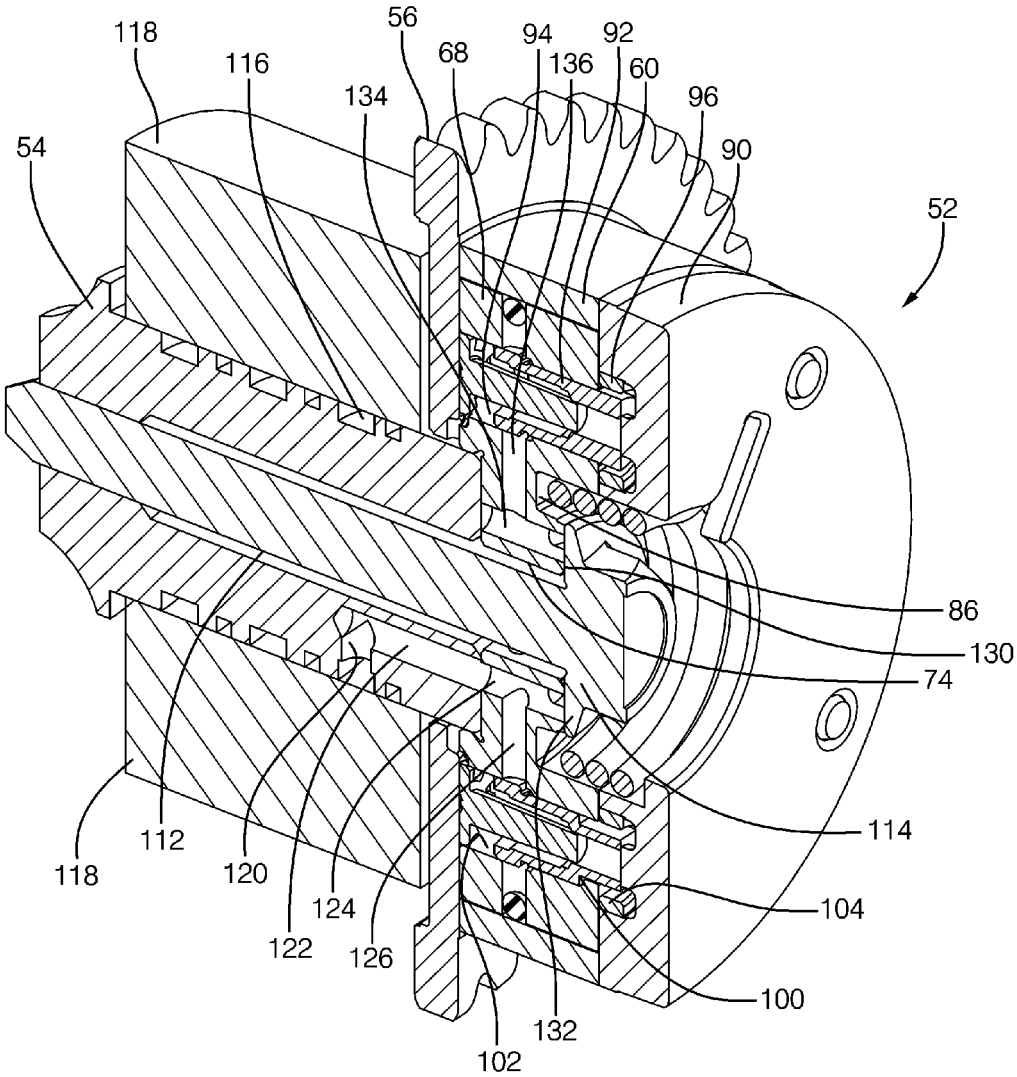
FIG. 3 is an isometric axial cross-section of the camshaft phaser of FIG. 2.
Figure 5:
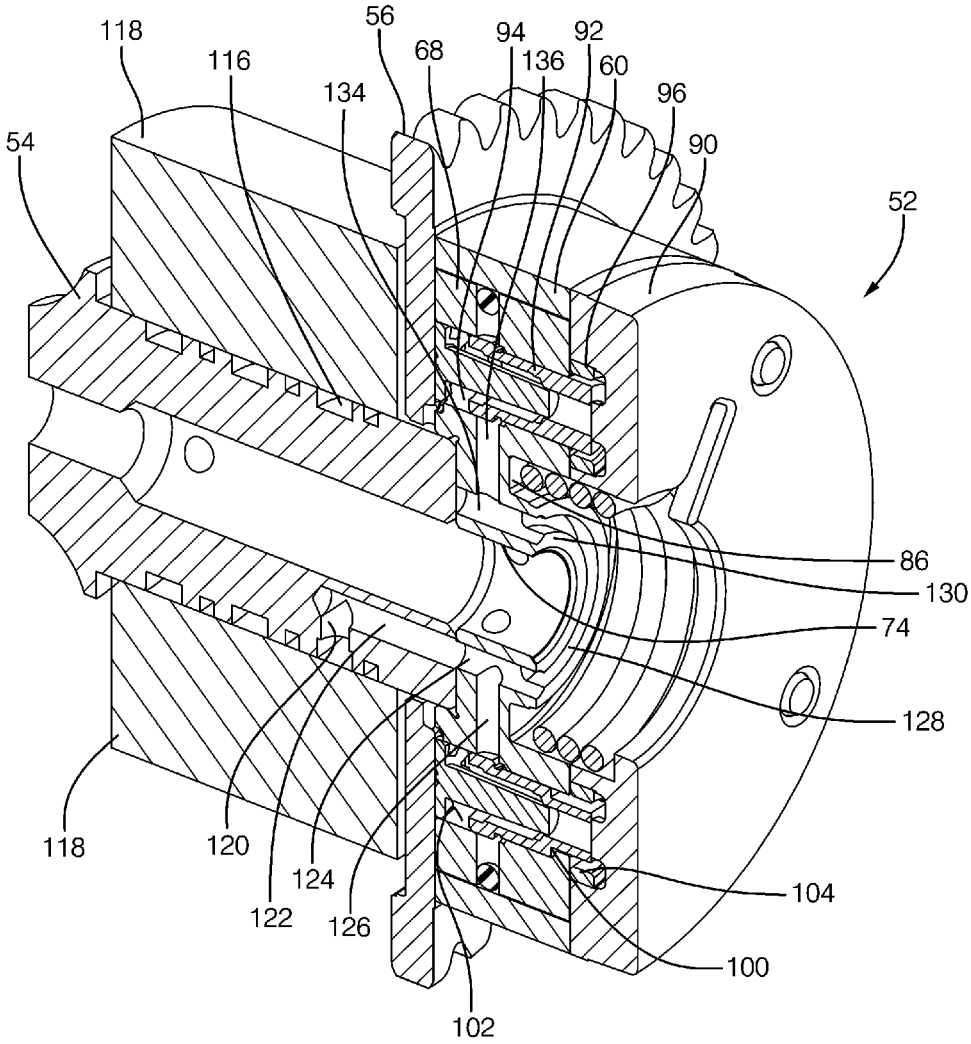
FIG. 5 is an isometric axial cross-section of the camshaft phaser of FIG. 2 without the camshaft phaser attachment bolt.

Lock pin rotor oil passage 124 is also in fluid communication with primary lock pin bore 94/primary lock pin 92. Fluid communication from lock pin rotor oil passage 124 and primary lock pin bore 94/primary lock pin 92 is provided in part by bridging lock pin oil passage 128 which is formed as a groove in axial face 130 of rotor 68. Bridging lock pin oil passage 128 is arcuate to fit radially in the space between central through bore 74 and annular pocket 86. A cap is provided axially adjacent to rotor 68 to seal the axial end of bridging lock pin oil passage 128. In FIGS. 2 and 3, the cap takes the form of flange 132 extending radially outward from head 114 of camshaft phaser attachment bolt 112. In this way, bridging lock pin oil passage 128 is defined between rotor 68 and flange 132 when camshaft phaser attachment bolt 112 is tightened to the predetermined torque. While the cap is shown in FIGS. 2-3 as an integral part of head 114, it should be understood that the cap could also be a washer of separate construction from head 114. Primary lock pin oil passage 134 extends axially through rotor 68 from bridging lock pin oil passage 128. While primary lock pin oil passage 134 is shown in FIGS. 3 and 5 as extending to the axial face of camshaft 54 where it is terminated and sealed by camshaft 54, it should be understood that primary lock pin oil passage 134 may be truncated within rotor 68 and extend only part way into rotor 68 from bridging lock pin oil passage 128. Finally, primary lock pin connecting passage 136 extends radially from primary lock pin rotor oil passage 134 to primary lock pin bore 94. In this way, fluid communication between primary lock pin 92 and secondary lock pin 100 is provided within camshaft phaser 52, thereby requiring only one hydraulic connection between camshaft 54 and camshaft phaser 52 for controlling primary and secondary lock pins 92, 100.

Figure 6:
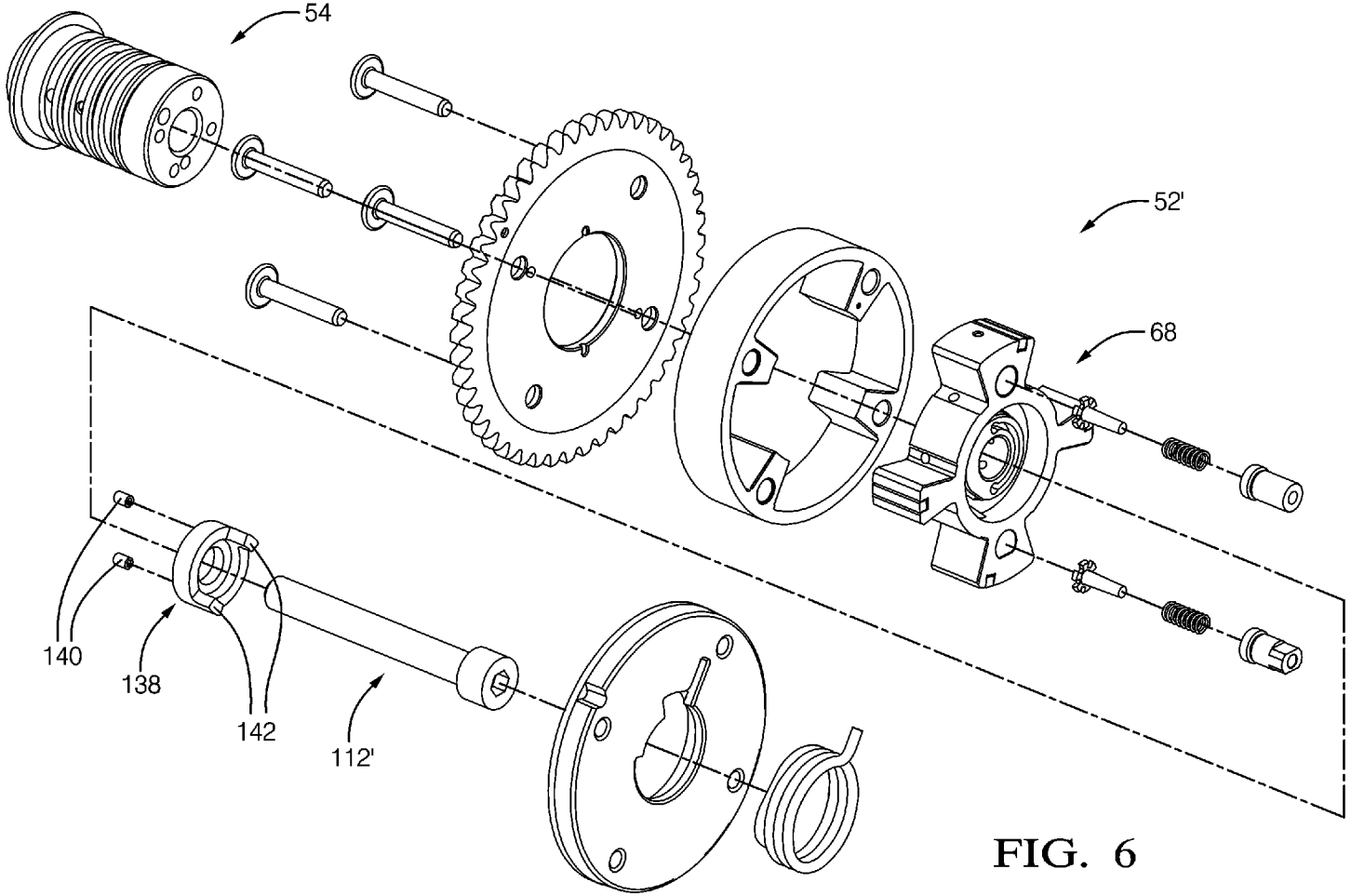
FIG. 6 is an exploded isometric view of a portion of a camshaft phaser in accordance with a second embodiment of the present invention.
Figure 7:
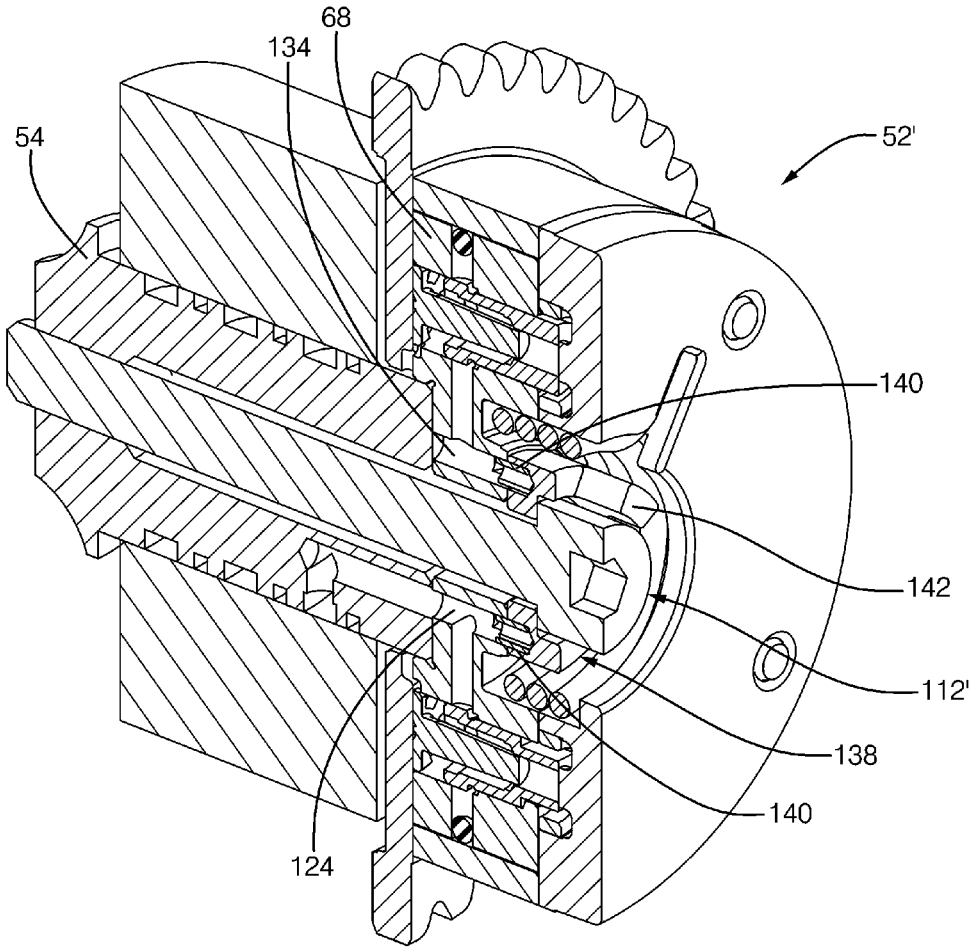
FIG. 7 is an axial cross-section of the camshaft phaser of the second embodiment of the present invention.

Now referring to FIGS. 6 and 7, camshaft phaser 52' is shown as a second embodiment. Camshaft phaser 52' is the same as camshaft phaser 52 described earlier with the exception of the cap used to seal the axial end of bridging lock pin oil passage 128. In the second embodiment, the cap is shown as bushing 138 which is formed as a separate piece from camshaft phaser attachment bolt 112'. Camshaft phaser attachment bolt 112' extends coaxially through bushing 138 and relative rotation between bushing 138 and camshaft phaser attachment bolt 112' is allowed while camshaft phaser attachment bolt 112' is being tightened to the predetermined torque. Relative rotation between bushing 138 and camshaft phaser attachment bolt 112' is needed in this embodiment because bushing 138 is used to prevent rotation of rotor 68/camshaft 54 while camshaft phaser attachment bolt 112' is being tightened to the predetermined torque.

Bushing 138 includes clocking features for radially orienting bushing 138 with rotor 68 and for preventing rotation of bushing 138 relative to rotor 68. In FIGS. 6 and 7, the clocking features are shown as pins 140 which extend axially therefrom only part way into lock pin rotor oil passage 124 and primary lock pin oil passage 134 as to not prevent fluid communication of lock pin rotor oil passage 124 and primary lock pin oil passage 134 with bridging lock pin oil passage 128. Pins 140 are sized to be close fitting with lock pin rotor oil passage 124 and primary lock pin oil passage 134 in order to prevent relative rotation between bushing 138 and rotor 68. The width of bridging lock pin oil passage 128 may be smaller than the diameter of pins 140 to better prevent rotation between bushing 138 and rotor 68.

Bushing 138 also includes anti-rotation features used to prevent rotation of rotor 68/camshaft 54 while camshaft phaser attachment bolt 112' is being tightened to the predetermined torque. In FIGS. 6 and 7, these anti-rotation features are shown as tangs 142 which extend axially away from bushing 138. In use, tangs 142 may be used to engage a holding tool which is used to hold bushing 138/rotor 68/camshaft 54 substantially stationary while camshaft phaser attachment bolt 112' is tightened to the predetermined torque using a tightening tool (not shown). While the anti-rotation features used to prevent rotation of rotor 68/camshaft 54 while camshaft phaser attachment bolt 112' is being tightened to the predetermined torque are shown as tangs 142, it should now be understood that other features may also be used, for example, but not limited to slots or holes extending into bushing 138, or flats on the outer circumference of bushing 138.

While not shown, a third embodiment may include a cap of separate construction from the camshaft phaser attachment bolt. In this embodiment, the cap may include a cylindrical extension which is sealingly press fit within the central through bore of the rotor. The groove in the axial face of the rotor may now extend to the central through bore of the rotor.

While bridging lock pin oil passage 128 has been shown as a groove formed in axial face 130 of rotor 68, it should now be understood that the groove could instead be formed in the surface of the cap that faces rotor 68. As a further alternative, a groove could be formed in both the rotor 68 and the cap.

While bridging lock pin oil passage 128 has been shown as a semicircular groove, it should now be understood that lock pin oil passage 128 may be formed as a complete circle. In this arrangement, the width of the groove may be made smaller since the oil has two paths to follow.

While this invention has been described in terms of preferred embodiments thereof, it is not intended to be so limited, but rather only to the extent set forth in the claims that follow.

I claim:

1. A camshaft phaser for use with an internal combustion engine for controllably varying the phase relationship between a crankshaft and a camshaft in said internal combustion engine, said camshaft phaser comprising:

a stator having a plurality of lobes and connectable to said crankshaft of said internal combustion engine to provide a fixed ratio of rotation between said stator and said crankshaft;

a rotor coaxially disposed within said stator, said rotor having a plurality of vanes interspersed with said lobes defining alternating advance chambers and retard chambers, wherein said advance chambers receive pressurized oil in order to change the phase relationship between said crankshaft and said camshaft in the advance direction and said retard chambers receive pressurized oil in order to change the phase relationship between said camshaft and said crankshaft in the retard direction, said rotor being attachable to said camshaft of said internal combustion engine to prevent relative rotation between said rotor and said camshaft;

a primary lock pin disposed within one of said rotor and said stator for selective engagement with a primary lock pin seat for limiting a change in phase relationship between said rotor and said stator to a range between full advance and full retard when said primary lock pin is engaged with said primary lock pin seat, wherein pressurized oil is selectively supplied to said primary lock pin in order to disengage said primary lock pin with said primary lock pin seat, and wherein oil is selectively vented from said primary lock pin in order to engage said primary lock pin with said primary lock pin seat;

a secondary lock pin disposed within one of said rotor and said stator for selective engagement with a secondary lock pin seat for preventing a change in phase relationship between said rotor and said stator at a predetermined position within said range when said secondary lock pin is engaged with said secondary lock pin seat, wherein pressurized oil is selectively supplied to said secondary lock pin in order to disengage said secondary lock pin with said secondary lock pin seat, and wherein oil is selectively vented from said secondary lock pin in order to engage said secondary lock pin with said secondary lock pin seat;

a cap disposed axially adjacent said rotor to define a bridging lock pin oil passage between said rotor and said cap, said bridging lock pin oil passage providing fluid communication between said primary lock pin and said secondary lock pin.

2. A camshaft phaser as in claim 1, wherein said bridging lock pin oil passage is a groove formed in an axial face of one of said rotor and said cap.

3. A camshaft phaser as in claim 1 further comprising a camshaft phaser attachment bolt extending coaxially through said cap and said rotor and being threadably engagable with said camshaft for clamping said rotor to said camshaft, wherein said cap is clamped to said rotor by said camshaft phaser attachment bolt.

4. A camshaft phaser as in claim 3 wherein said cap is formed integrally with said camshaft phaser attachment bolt.

5. A camshaft phaser as in claim 3 wherein said cap includes clocking features for radially orienting said cap with said rotor and for preventing rotation of said cap relative to said rotor while said camshaft phaser attachment bolt is being tightened.

6. A camshaft phaser as in claim 5 wherein said cap includes anti-rotation features for engagement with a tool to prevent rotation of said rotor and said camshaft while said camshaft phaser attachment bolt is being tightened.

* * * * *